United States Patent [19]

Olivieri

[11] Patent Number: 4,674,156

[45] Date of Patent: Jun. 23, 1987

[54] LEVER-AND-RING TYPE SKI-BOOT FASTENING WITH A DEVICE FOR ADJUSTING THE TIGHTNESS OF THE FASTENING

[75] Inventor: Oliviero Olivieri, Montebelluna, Italy

[73] Assignee: Icaro Olivieri & C. S.p.A., Montebelluna, Italy

[21] Appl. No.: 710,108

[22] Filed: Mar. 11, 1985

[30] Foreign Application Priority Data

Mar. 20, 1984 [IT] Italy ..... 21293[U]

[51] Int. Cl.[4] ..... A43C 11/00

[52] U.S. Cl. ..... 24/71 SK; 24/70 SK

[58] Field of Search ..... 24/69 R, 69 SK, 70 R, 24/70 SK, 71 R, 71 ST, 71 SK, 68 R, 68 SK, 580–585, 705, 586, 70 ST; 36/50

[56] References Cited

U.S. PATENT DOCUMENTS

| | | | |
|---|---|---|---|
| 318,369 | 5/1885 | Gottstein | 24/584 X |
| 2,199,444 | 5/1940 | Rauglas | 24/70 SK X |
| 2,967,342 | 1/1961 | Henry | 24/581 |
| 4,011,634 | 3/1977 | Olivieri | 24/70 SK |
| 4,115,905 | 9/1978 | Seidel | 24/70 SK X |
| 4,326,320 | 4/1982 | Riedel | 24/70 SK |
| 4,522,424 | 6/1985 | Luitz et al. | 24/68 SK X |

FOREIGN PATENT DOCUMENTS

| | | | |
|---|---|---|---|
| 438545 | 9/1949 | Italy | 24/583 |
| 694728 | 9/1965 | Italy | 24/70 SK |

*Primary Examiner*—Kenneth J. Dorner
*Assistant Examiner*—James R. Brittain
*Attorney, Agent, or Firm*—Fleit, Jacobson, Cohn & Price

[57] ABSTRACT

A lever-and-ring type ski-boot fastening in which the ring is releasably engageable with one of a plurality of hooks mutually spaced-apart by an interspacing. The hooks are formed on a plate-shaped body guided by a base-plate for movements towards and away from the lever by displacements equal to a fraction of the interspacing. Retaining teeth interengageable in a pawl-like manner are provided to releasably lock the plate-shaped body to the base-plate.

2 Claims, 4 Drawing Figures

LEVER-AND-RING TYPE SKI-BOOT FASTENING WITH A DEVICE FOR ADJUSTING THE TIGHTNESS OF THE FASTENING

BACKGROUND OF THE INVENTION

The present invention relates to a ski-boot fastening of the so-called lever-and-ring type, having a device for adjusting the tightness of the fastening.

Until now, the tightness of a ski-boot fastening of the type considered has been achieved in two basic stages: a coarse adjustment by means of the engagement of the ring with an appropriate hook of a plurality of hooks formed or otherwise fixed on a base-plate, and a fine adjustment by means of a screw mechanism usually interposed between the lever and the ring, or an equivalent tightening unit for the ring.

In most ski-boot fastenings currently in use, the fine adjustment may be made directly under load, that is, when the ring is actually subject to the action of the lever or the respective tightening unit.

Now, the fine adjustment stage is usually long and laborious, in view of the fact that the distance (interspacing) between two adjacent hooks on the base-plate is preferably constant for reasons of mechanical strength, which involves the making of hooks of a constant thickness, and the fact that the number of hooks is limited (generally to two or three hooks) particularly for reasons of size (a base-plate of limited dimensions).

In fact, once the ring has been engaged with the particular hook which, out of all the hooks on the base-plate, permits the closure of the fastening with the best possible tightness, the optimum tightness of the fastening is obtained by operating the micrometric screw of the fine adjustment mechanism. The significant amount of time involved in this operation is actually due to the high value of the ratio between the interspacing of the hooks on the base-plate and the pitch of the micrometric screw.

SUMMARY OF THE INVENTION

The main object of the present invention is that of providing a ski-boot fastening with a device for adjusting the fastening tightness, which has structural and functional characteristics such as to overcome the disadvantage mentioned above, with reference to the prior art.

This object, as well as others which will become more apparent from the description that follows, is achieved by means of a so-called lever-and-ring type ski-boot fastening having a plurality of hooks releasably engageable by the ring and mutually spaced apart by an interspacing, wherein the hooks are formed on a plate-shaped body guided on a base-plate for movement towards and away from the lever by displacements equal to a fraction of the interspacing, retaining means being provided for releasably locking the body to the base-plate.

BRIEF DESCRIPTION OF THE DRAWINGS

Further characteristics and advantages of the ski-boot fastening of the invention will become more apparent from the detailed description which follows with reference to the appended drawings, provided purely by way of example, in which.

DESCRIPTION OF A PREFERRED EMBODIMENT

Figure 1:
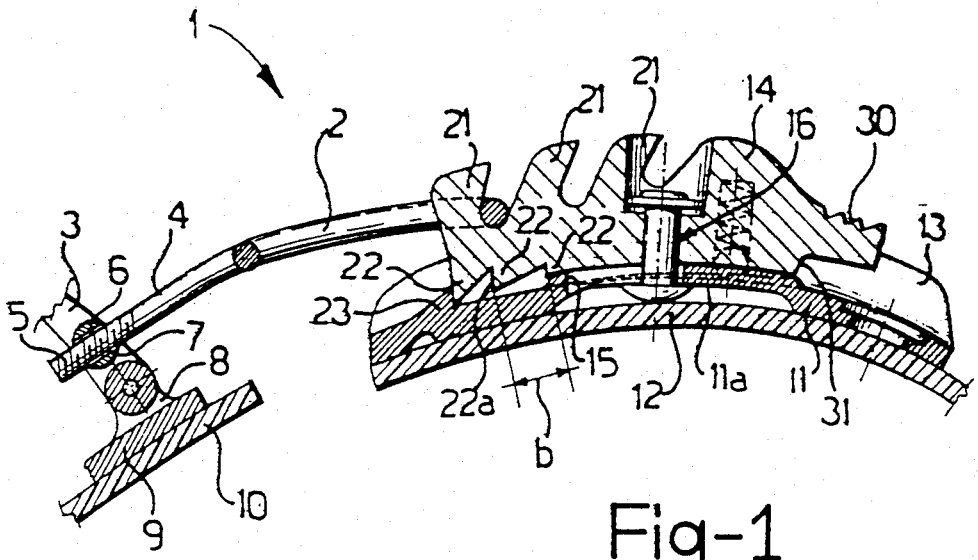
FIG. 1 is a schematic longitudinal section a sk-boot fastening according to the invention in one condition of use.
Figure 2:
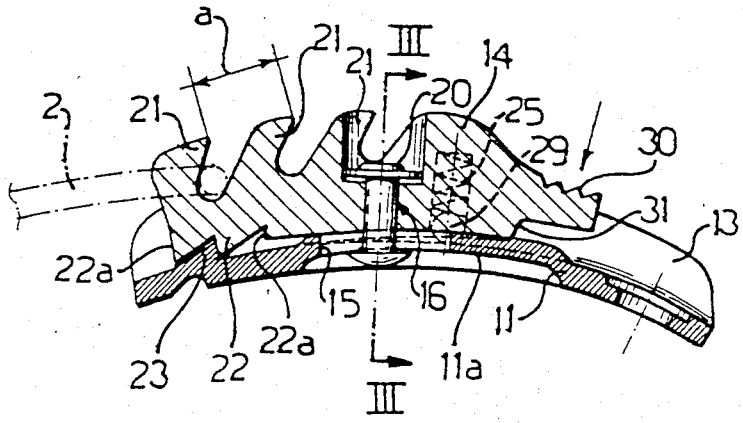
FIG. 2 is a longitudinal section of a detail of the fastening of FIG. 1 in another condition of use.
Figure 3:
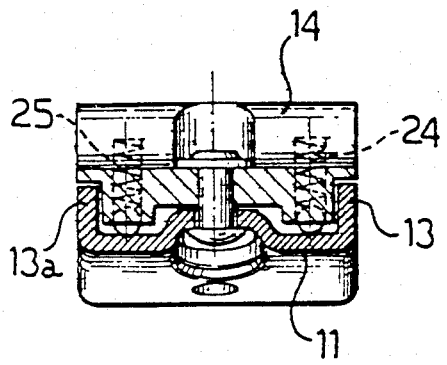
FIG. 3 is a section of the same detail taken on the line III—III of FIG. 2.
Figure 4:
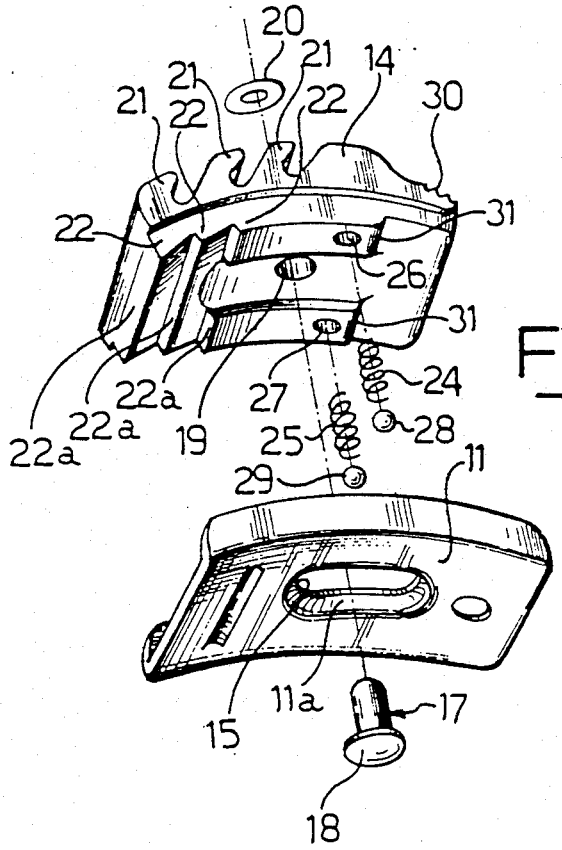
FIG. 4 is an exploded perspective view of the detail of FIG. 2 from below.

With reference to the drawings, there is illustrated a ski-boot fastening of the so-called lever-and-ring type, schematically indicated 1, in which a metal ring 2 is subject to the action of a lever 3 through a draw-rod 4. A threaded section 5 of the draw-rod 4 constitutes, in cooperation with a core 6 with a threaded through-hole 7, a device for the fine adjustment of the tightness of the fastening 1. This device is operated in an entirely conventional manner, not illustrated.

Also in an entirely conventional manner, the lever 4 is pivoted on a support 8 formed or otherwise fixed on a base 9 through which the lever 4 is attached to a portion 10 of the upper of a ski-boot (not illustrated).

A base-plate 11 attachable by known means (not illustrated) to another portion 12 of the upper of the ski-boot in question has respective raised edges 13, **13*a*** along its two opposite longer sides, which give this base-plate substantially a channel appearance.

A plate-shaped body 14 is mounted on the base-plate 11 between its edges 13, **13*a***, and is movable parallel to the edges which thus constitute guides for its sliding.

Any displacements of the body 14 relative to the base-plate 11 are limited in both directions by appropriate stop means.

In accordance with a preferred embodiment, these stop means comprise an elongate eye-like slot 15 formed in the base-plate 11 and extending in the direction of displacement of the body 14, and a peg 16 rigid with the body 14 and passing through the slot 15 with a slidable engagement. In particular, the peg 16 is formed by a pin 17 with a mushroom head 18 having a diameter greater than the width of the slot 15. This pin 17 is engaged with predetermined play in a hole 19 formed in a substantially central position in the thickness of the body 14. Conventional means, indicated 20, retain the pin 17 in the hole 19 with the possibility of limited axial movement, thus effecting a relatively loose connection between the body 14 and the base-plate 11.

It should be noted that the aforementioned slot 15 is formed in a recessed portion of the base-plate 11, provided expressly to accommodate the mushroom head 18 of the pin 17.

Three identical, equidistant, hook-shaped projections 21, with each of which the free end of the ring 2 is releasably engageable, are formed in one wall of the plate-shaped body 14.

In the wall of the plate-shaped body 14 opposite that first mentioned, that is, the wall facing the base-plate 11, are formed transversely three identical, equidistant, straight teeth 22 of saw-toothed cross-section. When the plate-shaped body 14 and the associated base-plate 11 are mounted on a portion 12 of a ski-boot upper, each of the teeth 22 has a surface **22*a* facing the ring 2**.

According to a fundamental characteristic of this invention, the interspacing b of the teeth 22 corresponds to a fraction of the interspacing a of the hooks 21, preferably half the interspacing a of the hooks.

The teeth 22 are engageable, in an essentially pawl-like manner, with a counter-tooth 23, formed transversely on the base-plate 11, as will be explained in the following part of the description.

It should be noted that counter-tooth 23 and the teeth 22 cooperating therewith are formed respectively on the end portions of the base-plate 11 and plate-shaped body 14 facing the ring 2.

Resilient members capable of maintaining the aforesaid engagement between a tooth 22 and the counter-tooth 23 are interposed between the plate-shaped body 14 and the base-plate 11. According to a preferred embodiment, the resilient members comprise a pair of helical springs 24, 25 housed in corresponding blind holes 26, 27 formed in the thickness of the plate-shaped body 14 and opening on the wall of the body facing the base-plate 11.

The helical springs 24 and 25 act upon the base-plate 11 through respective interposed balls 28, 29.

It should be noted that the helical springs 24, 25 of the plate-shaped body 14 are positioned in such a way that, when the plate-shaped body is coupled with the base-plate 11, the balls 28, 29 are pressed onto this base-plate in symmetrical lateral positions relative to the slot 15.

Finally, the plate-shaped body 14 is provided a knurled end portion 30 for facilitating the manipulation of this plate-shaped body during the operation of the fastening of the present invention.

In particular, this portion 30 has a smaller thickness than the plate-shaped body 14 which consequently defines a transverse step 31 adjacent its end remote from the ring 2.

A method of fastening the above-described ski-boot fastening will now be described.

In an initial condition (FIG. 1), the plate-shaped body 14 is moved as far from the lever 3 as it can go and, in this condition, the first tooth 22 (that is the one closest to the lever 3) is kept in pawl-like engagement with the counter-tooth 23 by the springs 24, 25.

The fastening is fastened in a conventional manner by means of the lever 3 and with the prior engagement of the ring 2 with one of the hooks 21, for example the first of these hooks (FIG. 1). If the tightness of the fastening is not satisfactory, the fastening is reopened and the ring 2 is engaged with the second hook 21.

The tightness obtained upon the subsequent fastening may be satisfactory, in which case it can be optimised if necessary by means of the fine adjustment permitted by the screw 5, or the tightness of the fastening may be excessive. In this case, the engagement of the ring 2 with the second hook 21 being maintained, the knurled portion 30 of the plate-shaped body 14 can be pressed to cause, against the action of the springs 24, 25, the disengagement of the first tooth 22 from the counter-tooth 23. As a result, the body 14 will be displaced towards the lever 3 until the second tooth 22 is engaged with the counter-tooth 23, this displacement being equal to an interspacing b. In this case, the tightness of the fastening will be in between those tried previously. If necessary, it can be optimised by operating the micrometric screw 5.

According to the prior art, it would be necessary again to release the ring from the second hook 21, re-engage this ring with the first hook 21, close the fastening, and then obtain the desired tightness by operating the micrometric screw: a very lengthy procedure given the high ratio between the interspacings a of the hooks 21 and the pitch b of the micrometric screw used.

What is claimed is:

1. A lever-and-ring type fastening for ski-boots, said fastening comprising: a ring; a lever pivotally connected to the ring; a plurality of hooks releasably engageable by the ring and mutually spaced-apart by an interspacing; a plate-shaped body on which the hooks are formed; a base-plate on which said plate-shaped body is guided for movement towards and away from said lever by displacements equal to a fraction of said interspacing, wherein the base-plate has a pair of spaced longitudinal raised edges to define substantially a channel shape in cross section, and the plate-shaped body is movably mounted between and guided by said edges, the base-plate including an elongate slot parallel to said raised edges, and the plate-shaped body including a pin connected thereto and movably engaged in said slot, the plate-shaped body including a hole in which said pin is mounted with predetermined play and with the possibility of axial movement; retaining means carried by one of said plate-shaped body and said base plate for releasably locking said body to said base-plate, said retaining means including a plurality of identical teeth which are formed transversely in said plate-shaped body in a position facing said base-plate and are equally spaced-apart by an interspacing equal to a fraction of the interspacing of the hooks, and a counter-tooth formed transversely in said base-plate and engageable with one of said teeth in an essentially pawl-like manner; resilient means interposed between the plate-shaped body and the base-plate to assist the essentially pawl-like engagement between one of said teeth and said counter-tooth, said resilient means and said teeth of said plate-shaped body positioned on opposite sides of said pin to permit the teeth of said plate-shaped body and the counter-tooth of said base plate to be selectively engageable and to be disengageable by pivoting said plate-shaped body to permit relative sliding movement between said plate-shaped body and said base plate.

2. A fastening as defined in claim 1, wherein the interspacing of the teeth is equal to half the interspacing of the hooks.

* * * * *